United States Patent [19]

Zeidman et al.

[11] 4,293,045

[45] Oct. 6, 1981

[54] IMPACTING DEVICE

[76] Inventors: Zvi Zeidman, 81 Hacarmel St.; Carol Goldenberg, 21/21 Jerusalem St.; Zvi Grinbaum, 50 Ben-Gurion St., all of Kfar-Saba, Israel

[21] Appl. No.: 100,980

[22] Filed: Dec. 6, 1979

[51] Int. Cl.[3] ..... B25D 9/04

[52] U.S. Cl. ..... 173/121; 173/126; 91/325

[58] Field of Search ..... 173/121, 126; 91/325, 91/402, 243; 92/129, 63

[56] References Cited

U.S. PATENT DOCUMENTS

| | | | |
|---|---|---|---|
| 1,609,502 | 12/1926 | Thomas | 91/243 X |
| 2,854,953 | 10/1958 | Osborne | 173/121 X |
| 3,028,840 | 4/1962 | Leavell | 91/325 X |
| 3,285,104 | 11/1966 | Baumann | 173/121 X |
| 3,792,740 | 2/1974 | Cooley | 172/126 X |

*Primary Examiner*—Werner H. Schroeder
*Assistant Examiner*—Andrew M. Falik
*Attorney, Agent, or Firm*—Benjamin J. Barish

[57] ABSTRACT

An impacting device useful with a pneumatic drive comprises a housing formed with an outer large-diameter bore and an inner small-diameter bore defining an annular shoulder at their juncture. A driving element within the large-diameter bore is limited against movement by the annular shoulder. A plunger movable within both bores is urged by a spring into the large-diameter bore in engagement with the driving element and carries an impacting element, such as a ball, at its opposite end. A air-vent formed through the housing wall is in communication with the first bore at a location so as to be on the inner side of the driving element when the latter is in its initial position, and at the opposite side of the driving element when the latter has been driven by pressurized air pulses to limit against the annular shoulder. Thereafter the plunger continues moving, under its own inertia, to cause the impacting element at the outer end of the plunger to engage the workpiece.

10 Claims, 2 Drawing Figures

IMPACTING DEVICE

BACKGROUND OF THE INVENTION

The present invention relates to impacting devices. The invention is particularly useful with respect to impacting devices driven by pneumatic drives and is therefore described below with respect to this application.

More particularly, the invention is especially useful in pneumatically-driven tools for punching or embossing workpieces, such as plastic or leather sheets and films, at high speeds and while the workpiece is in movement, i.e. impacting "on the fly". Many sheet impacting devices are known, but as a rule they are of expensive construction, or operate at relatively low speeds, or require intermittent movement of the sheet so as to impact it while it is relatively stationary.

An object of the present invention is to provide an impacting device, particularly useful with pneumatic drives, which is of very simple and inexpensive construction, and which can operate at a very high speed, in the order of about 7,000 cycles per minute, for punching, embossing or otherwise forming workpieces while they are moved in a continuous manner.

SUMMARY OF THE INVENTION

According to one aspect of the present invention, there is provided an impacting device comprising: a housing formed with a first cylindrical bore at one end, and with a second cylindrical bore at the opposite end coaxial with but of smaller diameter than the first bore so as to define an internal annular shoulder at the juncture of the two bores. A driving element is movable within the first cylindrical bore and has an outer diameter greater than that of the internal annular shoulder so as to limit against it. A plunger is movable within the first and second cylindrical bores and has its inner end face engageable with the inner end face of the driving element. An impacting element is carried by the opposite end face of the plunger, and a spring is interposed between the housing and the plunger urging the plunger into engagement with the driving element, and also urging the driving element to its initial position away from the internal annular shoulder. Further, an air-vent opening is formed through the housing wall communicating with the first bore at a location thereof so as to be between the inner face of the driving element and the internal annular shoulder when the driving element is in an initial position, and to be at the opposite face of the driving element when the latter is in its driven position limiting against the internal annular shoulder.

The impacting device is particularly useful with pneumatic drives wherein high-pressure air pulses are applied at a high frequency to the driving element driving it, and the plunger, inwardly of the bores until the driving element engages the internal annular shoulder. At that time, the inward movement of the driving element is terminated but the plunger continues under its own inertia to cause the impacting element (itself, or via an intervening element) to impact the workpiece and thereby to produce the hole, embossment, or other formation while the workpiece is in movement. It has been found that such impacting devices, particularly when pneumatically-driven can operate at speeds of about 7,000 cycles per minute and even faster.

Preferably, the plunger has an outer diameter substantially equal to the inner diameter of the second housing bore, and is formed with a plurality of axially-spaced annular recesses along its length.

In one described embodiment, the driving element is a cup-shaped piston having a circular bottom wall and an annular side wall, the circular bottom wall being formed with a central opening of a diameter smaller than the plunger. In a second described embodiment, the driving element is of a solid disc-shaped construction.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
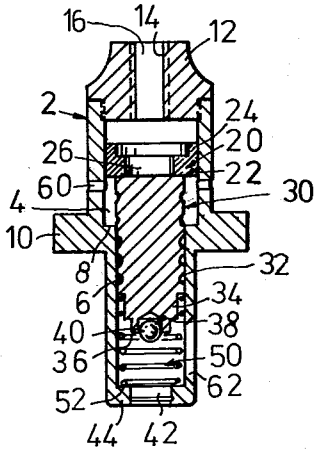
FIG. 1 is a longitudinal sectional view of one form of impacting device constructed in accordance with the invention.

The impacting device illustrated in FIG. 1 is particularly useful with a pneumatic drive (not shown) for producing holes or embossments in a workpiece (not shown), such as a plastic sheet, while the workpiece is in movement.

Briefly, the impacting device illustrated in FIG. 1 comprises a housing, generally designated 2, formed with a first bore 4 through its upper end and a second bore 6 through its lower end. Bore 6 is coaxial with bore 4, but is of smaller diameter than it, so that an inner annular shoulder 8 is defined at the juncture between the two bores. Housing 2 further includes an external annular flange 10 for mounting the housing in an apertured plate or the like (not shown), e.g. by fasteners passing through flange 10 into the mounting plate.

A cap 12 is removably attached, as by internal threads 14, to the upper end of housing 2. Cap 12 is adapted to receive a tube or the like (not shown) connected to a pneumatic drive for applying high-pressure pulses of air via a central opening 16 through cap 12 to bore 4 of the housing 2.

Disposed within bores 4 and 6 of housing 2 are a driving element 20, a plunger 30, an impacting device in the form of a ball 40 carried at the end of the plunger 30, and a spring 50 urging both the plunger 30 and the driving element 20 upwardly into the large-diameter bore 4 of the housing.

More particularly, driving element 20 is freely movable within the large-diameter bore 4. This element is in the form of a piston having a circular bottom wall 22 and an annular side wall 24 of an outer diameter substantially equal to preferably just slightly less than the inner diameter of bore 4 so as to be movable therein with a snug fit. Bottom wall 22 is formed with a central opening 26 of a diameter slightly less than the outer diameter of the upper face of plunger 30.

Plunger 30 is freely movable within both bores 4 and 6. It has an outer diameter substantially equal to, preferably just slightly less than, that of the small-diameter bore 6. As clearly shown in FIG. 1, the plunger is formed with a plurality of annular recesses 32 extending circumferentially around its outer face and axially spaced along its length. The lower end of plunger 30 is formed with a reduced-diameter step 34 terminating in an end face 36 of further reduced diameter, which end face is formed with a socket 38 for receiving the impacting ball 40.

Ball 40, preferably of steel or other hardened material, constitutes the element which is impacted by the operation of the device and which in turn impacts the workpiece (not shown). For this purpose, ball 40 is driven through a central opening 42 formed through the end 44 of housing 2 in alignment with the small-diameter bore 6, for piercing, embossing, or otherwise forming the workpiece as it is passed below opening 42. It will be appreciated that ball 40, instead of impacting directly the workpiece, could impact another interposing device (not shown) which in turn impacts the workpiece.

Spring 50 is a coiled compression spring interposed between an internal annular shoulder 52 formed at the end 44 of housing 2, around opening 42, and the lower end of the plunger 30. Compression spring 50 urges plunger 30 upwardly into engagement with piston 20, and the piston to its initial position at the upper end of its large-diameter bore 4, as shown in FIG. 1.

Housing 2 is further formed with a plurality of circumferentially-spaced air-vent openings 60 through its wall communicating with the large-diameter bore 4. These air-vent openings 60 are located so as to be between the internal annular shoulder 8 and the lower face of piston 20 during the initial position of the piston as illustrated in FIG. 1. Annular wall 24 of piston 20, however, is of such height that when the piston is moved to its driven position into engagement with annular shoulder 8, the upper edge of the piston annular wall clears the air-vent openings 60, so that in this driven position of the piston, the air-vent openings 60 are located outwardly of the outer face of the piston.

Housing 2 further includes a plurality of cooling slots 62 formed through its wall at the lower end of the small-diameter bore 6, adjacent to opening 42 through its end wall 44.

The device illustrated in FIG. 1 operates as follows: Normally, plunger 30 and piston 20 are urged by spring 50 to their upper or initial positions as illustrated in FIG. 1, with the upper face of the plunger in engagement with the lower apertured face 22 of the piston. When a pulse of high-pressure air is applied, via cap 12, into bore 4 of the housing, the air pulse drives piston 20 and plunger 30 downwardly, the air within bore 4 below plunger 20 being vented to the atmosphere via air-vent openings 60. Piston 20 is thus driven downwardly until it limits against the inner annular shoulder 8, at which time its downward movement is interrupted, but plunger 30 continues moving downwardly under its own inertia until ball 40, carried at its lower end, passes through opening 42 of the housing into engagement with the workpiece (not shown).

With the termination of the high-pressure air pulse, spring 50 returns plunger 30 and piston 20 to their initial positions preparatory for actuation by the next high-pressure air pulse. Should the high-pressure air pulse continue after piston 20 has been driven against shoulder 8, the upper face of the piston will have cleared the air-vent openings 60 so that the remainder of the air pulse would be vented to the atmosphere.

By using, for the driving element, the piston 20 having an apertured bottom wall, the mass of this driving element is reduced thereby permitting faster operation; also the creation of a vacuum is avoided between the lower face of piston 20 and the upper face of plunger 30 when the piston limits against shoulder 8 and the plunger continues to move under its own inertia, thereby avoiding dissipation of some of the energy of the plunger. The provision of the annular recesses 32 axially along the plunger 30 further decreases the mass of the plunger and also decreases the friction losses during its movement within bore 6. These features increase the speed capability of the device. Moreover, the provision of the air-vent openings 60 not only avoids dissipating energy by compression of air within bore 4, but also facilitates the cooling of the device, enabling it to operate at higher speeds without overheating. Cooling of the device is further enhanced by the provision of the cooling slots 62.

As indicated earlier, the device illustrated in FIG. 1, when pneumatically driven, has been found capable of punching holes "on the fly" in plastic sheets at speeds of 7,000 cycles per minute.

Figure 2:
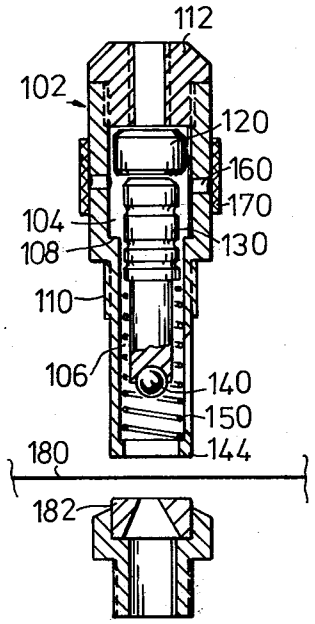
FIG. 2 is a longitudinal sectional view of another form of impacting device constructed in accordance with the invention.

The device illustrated in FIG. 2 is of similar construction as in FIG. 1, in that it includes a housing 102 formed with a large-diameter bore 104 at one end, and with a small-diameter bore 106 at its opposite end, the juncture of the bores defining an internal annular shoulder 108. The device of FIG. 2, however, instead of being mounted to an apertured plate (not shown) by mounting flanges (10, in FIG. 1), is illustrated as formed with external threads 110 for mounting in an internally-threaded apertured plate (not shown).

As in FIG. 1, a cap 112 is threadedly-attached to the outer end of housing 102 for coupling the housing, and particularly its large-diameter bore 104, to a pneumatic drive (not shown).

Whereas in FIG. 1 the driving element within the large-diameter bore (4) is a cup-shaped apertured piston (20), in the arrangement of FIG. 2 this driving element 120 is of a solid disc-shaped construction. Such a construction increases the mass of the driving element, and thereby increases the force applied by it to the plunger (130), but this increase in mass tends to decrease the maximum speed capability of the device as compared to the construction of FIG. 1.

The remainder of the FIG. 2 construction is basically the same as illustrated in FIG. 1, including the plunger 130 having an outer diameter substantially equal to the inner diameter of bore 106 and formed with axially-spaced annular recesses, the impacting element 140 (in the form of a ball) carried at the bottom of the plunger, and the spring 150 interposed between the plunger and the bottom apertured end 144 of the housing 102.

FIG. 2 illustrates the workpiece 180 passing between the bottom apertured end 144 of the housing and an apertured anvil 182 for being punched or embossed by the impacting ball 140 carried at the lower end of plunger 130.

Another difference in the FIG. 2 construction over that illustrated in FIG. 1 is the provision of a noise-suppression sleeve 170 surrounding the air-vent openings 160 formed through the housing wall at the large-diameter bore 104. This noise-suppression sleeve preferably is of a porous material, such as a sintered matrix of bronze balls, commonly used as filters.

While the invention has been described for use with a pneumatic drive, it will be appreciated that the driving element (20 or 120) may be driven by hydraulic or by mechanical impact. In addition, while the impacting element (40 or 140) is illustrated as being a ball for piercing or embossing the workpiece, such as plastic or leather sheets, it will be appreciated that other types of impacting elements could be used, such as pointed tools (e.g. an awl) for making holes in leather, plastic or the like, or other tools for otherwise performing working operations on the workpiece.

Many other variations, modifications and applications of the invention will be apparent.

What is claimed is:

1. An impacting device comprising:

a housing formed with a first cylindrical bore at one end and with a second cylindrical bore at the opposite end coaxial with but of smaller diameter than said first bore so as to define an internal annular shoulder at the juncture of the two bores;

a driving element movable within said first cylindrical bore and having an outer diameter greater than that of said internal annular shoulder so as to limit thereagainst;

a plunger movable within said first and second cylindrical bores and having its inner end face engageable with the inner end face of said driving element;

an impacting element carried by the opposite end face of said plunger;

a spring interposed between said housing and said plunger urging the plunger into engagement with the driving element, and also urging said driving element to an initial position away from said internal annular shoulder;

and an air-vent opening formed through the housing wall communicating with said first bore at a location thereof so as to be between the inner face of the driving element and the internal annular shoulder when the driving element is in its initial position, and to be at the opposite face of the driving element when the latter is in its driven position limiting against the internal annular shoulder.

2. A device according to claim 1, wherein said plunger has an outer diameter substantially equal to the inner diameter of said second housing bore, and is formed with a plurality of axially spaced annular recesses along its length.

3. The device according to claim 1, wherein said driving element has an outer diameter substantially equal to the inner diameter of said first housing bore.

4. A device according to claim 3, wherein said driving element is a cup-shaped piston having a circular bottom wall and an annular side wall, said bottom wall being formed with a central circular opening of a diameter less than that of the end face of the plunger.

5. A device according to claim 3, wherein said driving element is of solid disc-shaped configuration.

6. The device according to claim 1, wherein said impacting element is a ball fixed within a socket formed in the outer end of said plunger.

7. The device according to claim 1, further including a noise-suppression porous sleeve received around the housing over said air-vent opening.

8. The device according to claim 1, wherein said housing further includes an apertured cap attached thereto over the outer end of said first cylindrical bore to couple thereto a source of high-pressure air pulses for driving said driving element.

9. The device according to claim 1, wherein said spring is a coiled compression spring interposed between said plunger and a second internal annular shoulder formed in the housing wall at the outer end of said second bore.

10. The device according to claim 1, wherein the housing wall at the outer end of said second bore is formed with cooling slots.

* * * * *